US005592045A

United States Patent [19]

Dossot et al.

[11] Patent Number: 5,592,045

[45] Date of Patent: Jan. 7, 1997

[54] AUXILIARY COIL FASTENER IN A DEFLECTION YOKE

[75] Inventors: Alain Dossot, St. Saweur; Christophe Mathey; Alain Vougny, both of Dijon, all of France

[73] Assignee: Thomson Tubes & Displays, S.A., France

[21] Appl. No.: 461,096

[22] Filed: Jun. 5, 1995

[30] Foreign Application Priority Data

Jul. 1, 1994 [EP] European Pat. Off. ..... 94401501

[51] Int. Cl.[6] ..... H01J 29/70; H01J 29/46; H01F 7/00; H01H 1/00

[52] U.S. Cl. ..... 313/440; 313/450; 335/210; 335/213; 335/296

[58] Field of Search ..... 313/413, 440, 313/451, 414, 415, 416, 417, 450; 335/210, 213, 214, 296

[56] References Cited

U.S. PATENT DOCUMENTS 4,096,531 6/1978 Yamada ..... 335/213
4,429,293 1/1984 McGlashan ..... 335/211
5,436,536 7/1995 Van Der Wilk ..... 335/213

FOREIGN PATENT DOCUMENTS 0484606 5/1992 European Pat. Off. .
0592038 4/1994 European Pat. Off. .

OTHER PUBLICATIONS

IBM Technical Disclosure Bulletin, vol. 24, No. 5, Oct. 1981, pp. 2223–2224, "Low Capacitance Stator CRT Deflection Yoke" by Brownell, et al.

*Primary Examiner*—Sandra L. O'Shea
*Assistant Examiner*—John Ning
*Attorney, Agent, or Firm*—Joseph S. Tripoli; Joseph J. Laks; Sammy S. Henig

[57] ABSTRACT

A yoke separator or liner includes a body having a conical shape and a ring shaped retraining member that is attachable to a rear portion of the body by four pairs of pawls and studs. A beam s velocity modulation coil is installed on a support member made of flexible material using a printed circuit technique. The studs are inserted in orifices formed in the support member. The pawls snap onto the studs and press against the support member in a manner to secure the modulation coil.

14 Claims, 4 Drawing Sheets

FIG. 1

AUXILIARY COIL FASTENER IN A DEFLECTION YOKE

The invention relates to a deflection yoke for a cathode ray tube (CRT).

A deflection yoke for a CRT generally includes a pair of vertical deflection coils and a pair of horizontal deflection coils that are separated from the vertical deflection coils by a yoke liner or separator, generally made of plastic. The separator includes a main body that is funnel shaped. A flexible rear part of the separator is dimensioned to match the neck of the tube and establishes the position of the deflection yoke on the tube longitudinal or Z-axis. Attachment of the flexible rear part to the neck of the tube may be made by a clamp placed over the rear flexible part.

It is known to use a pair of auxiliary coils called horizontal scan rate beam scan velocity modulation (BSVM) coils. The BSVM is coils are used to improve the visible appearance of transitions between a dark part and a bright part of an image formed on a screen of the CRT, during the horizontal scan. The BSVM coils superimpose an auxiliary field upon the horizontal deflection field generated by the main horizontal deflection coils, in a way to anticipate any major variation in a brightness signal that provides picture information displayed on the screen. The auxiliary BSVM coils may be arranged on the neck of the tube, to overlap the horizontal deflection coils partially or totally. These auxiliary BSVM coils can be formed by engraving on a flexible, crown shaped strip a coil using printed circuit board fabrication techniques. Examples of such arrangements are described in published European patent application No. EP 484606. When a deflection yoke, including the auxiliary BSVM coils, is installed on the tube neck, the position of the BSVM coils with respect to the horizontal deflection coils is established in a manner to optimize their effect on the horizontal deflection field.

A deflection system, embodying an inventive feature, comprises a separator having a cylindrical shaped rear part and is provided with studs or projections. Auxiliary BSVM coils are provided in a manner to press against the wall of the separator An orifice, for as example, a hole or opening, is provided for cooperating with a given stud to fix the position of the auxiliary BSVM coils with respect to the horizontal and vertical deflection coils. The auxiliary BSVM coils may be held in position by a retaining device, embodying another inventive feature, which is attached to the body of the separator by a clipping arrangement.

A deflection yoke embodying an aspect of the invention includes a main deflection coil. An auxiliary deflection coil is mounted on a support having an opening and disposed around a neck of a tube for modifying a main deflection field of the main deflection coil. A separator is used for mounting the main and auxiliary deflection coils thereon. The separator includes a cylindrical part. The cylindrical part is provided with a positioning arrangement that cooperates with the opening for positioning the auxiliary coil against a wall of the separator.

Figure 1:
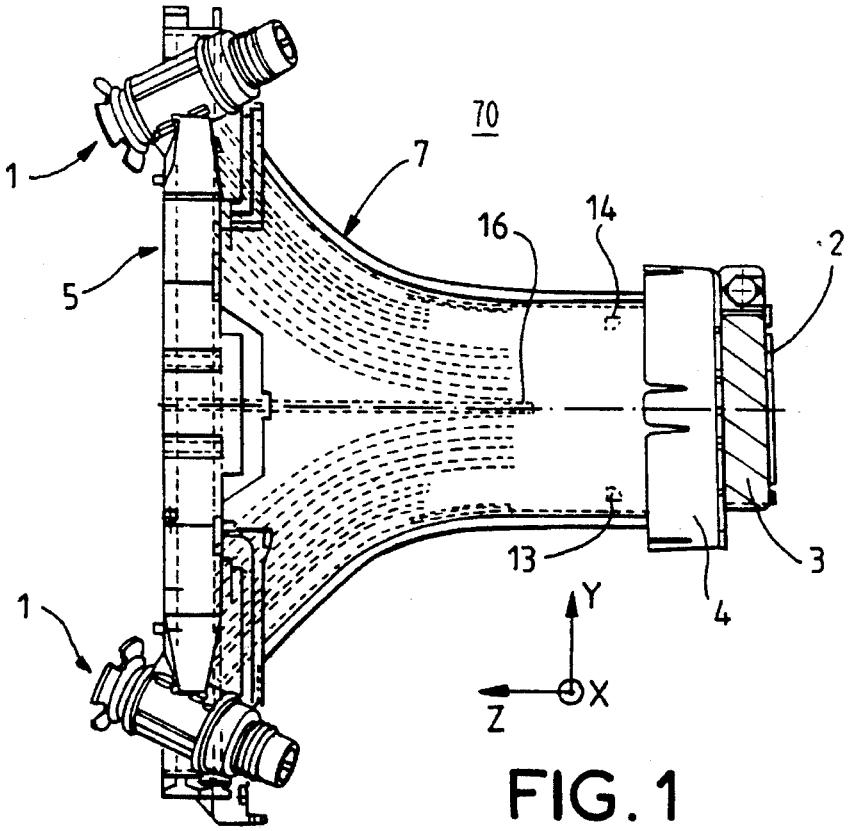
FIG. 1 illustrates a side view of a separator in accordance with an aspect of the invention.

FIG. 1 illustrates a separator 70, embodying an inventive feature. A beam deflection yoke for cathode ray tubes includes a pair of horizontal deflection coils, not shown, arranged around an inner wall of separator 70 and a pair of vertical deflection coils, not shown, arranged around an outer wall of separator 70. Separator 70 is made of plastic, and is designed to maintain in position as the pair of the horizontal deflection coils with respect to the vertical deflection coils to ensure the overall mechanical rigidity of the assembly obtained. As shown in FIG. 1, separator 70 includes four adjustable feet 1 for positioning a front part 5 of separator 70 on the CRT. A flexible crown 2 attaches a rear part 4 of separator 70 on the tube neck by a clamp 3. A main body 7 of separator 70, to which the deflection coils, not shown, are attached, and rear part 4 of separator s 70, are selectively detached from each other prior to assembly of the yoke. Body 7 and rear part 4 are selectively attached to each other when the yoke is assembled.

Figure 3:
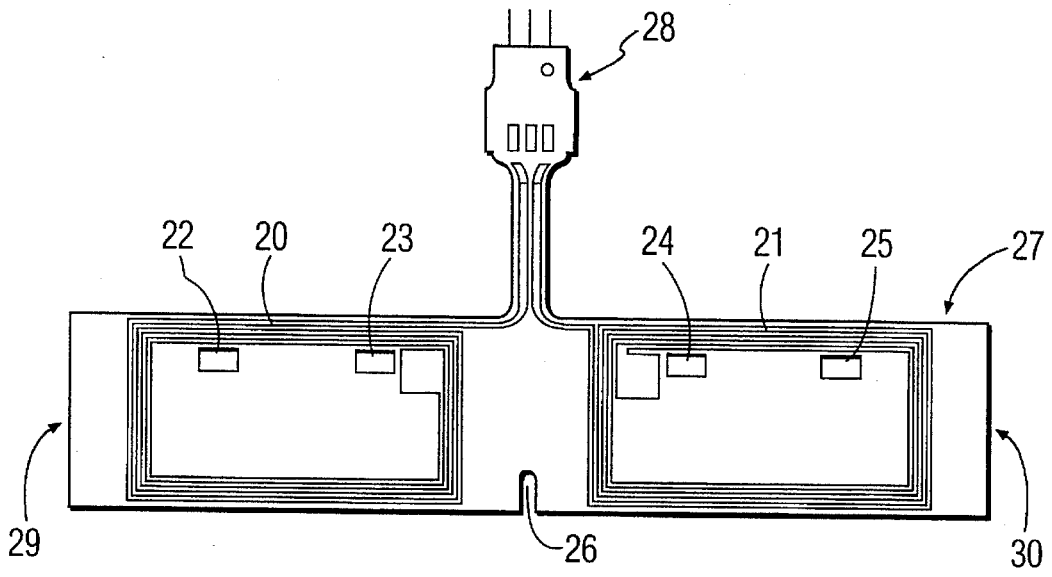
FIG. 3 shows a pair of auxiliary BSVM coils of FIG. 1.

A pair of auxiliary or BSVM coils 20 and 21 as shown in FIG. 3 are used for varying a horizontal deflection field, not shown. Coils 20 and 21 are engraved onto a flexible support 27 using printed circuit board fabrication techniques. Similar symbols and numerals in FIGS. 1 and 3 indicate similar items or functions. FIG. 3 also shows a drive connector 28, by means of which a horizontal rate current may be applied to coils 20 and 21 for varying the horizontal deflection field.

Positioning the pair of the BSVM coils 20 and 21 in separator 70 requires fixing their position with respect to the horizontal deflection coils, not shown, along the Z axis, and their angular position in the XY plane. The direction of the field produced by auxiliary coils 20 and 21 substantially coincides with the direction of the horizontal deflection of the horizontal deflection coils.

Figure 4:
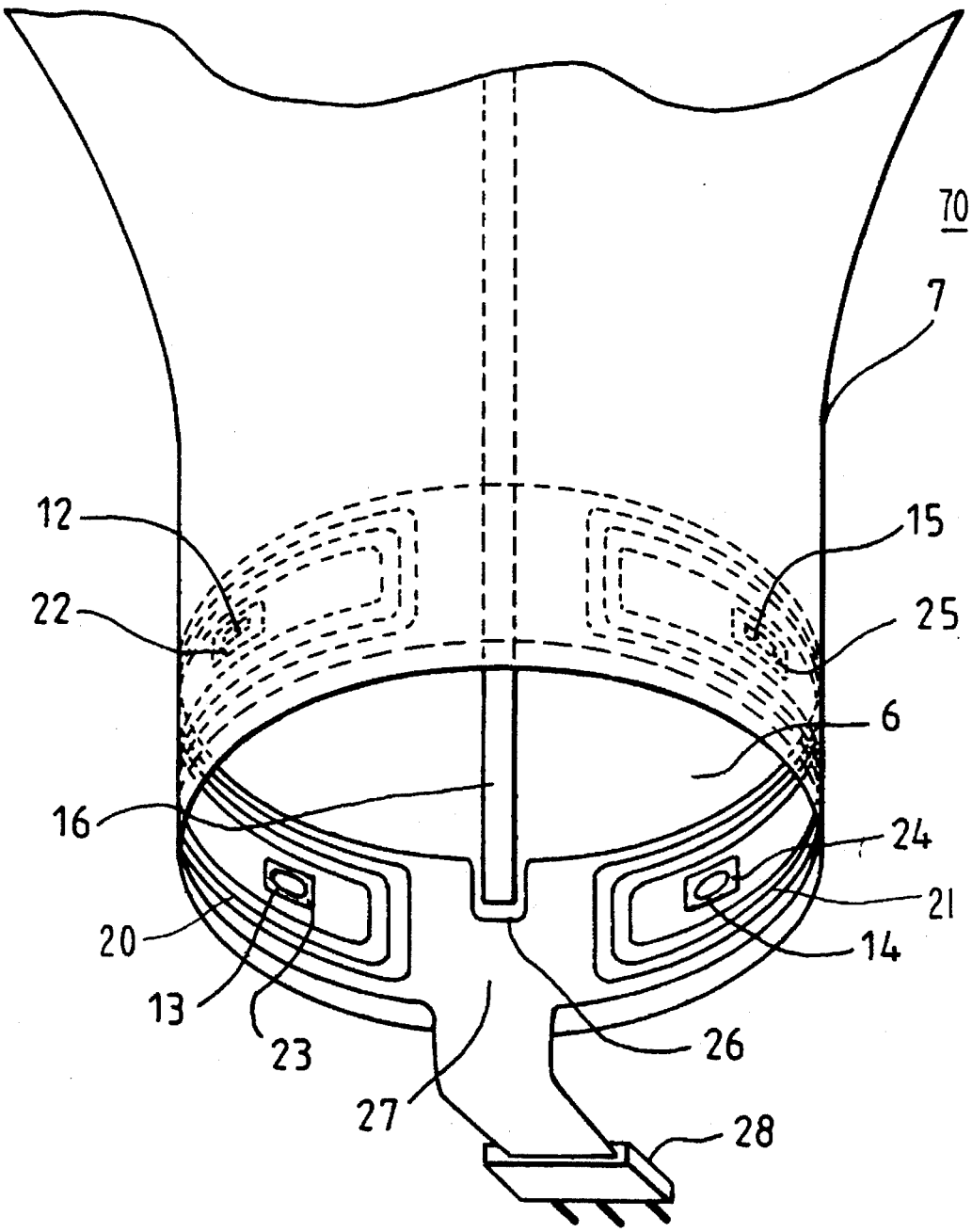
FIG. 4 illustrates in a perspective view the way the auxiliary BSVM coils are placed on the rear section of the separator of FIG. 1.

As shown FIG. 4, auxiliary coils 20 and 21 are placed around an internal cylindrical wall 6 at the rear of body 7 of separator 70 in a pre-determined position. Auxiliary coils 20 and 21 are placed by utilizing projections or studs 12, 13, 14 and 15, shown in FIGS. 4 and 1, projecting from wall 6 of separator 70. A notch or open slot 26 is provided for positioning the auxiliary coils. Similar symbols and numerals in FIGS. 1, 3 and 4 indicate similar items or functions.

Figure 2:
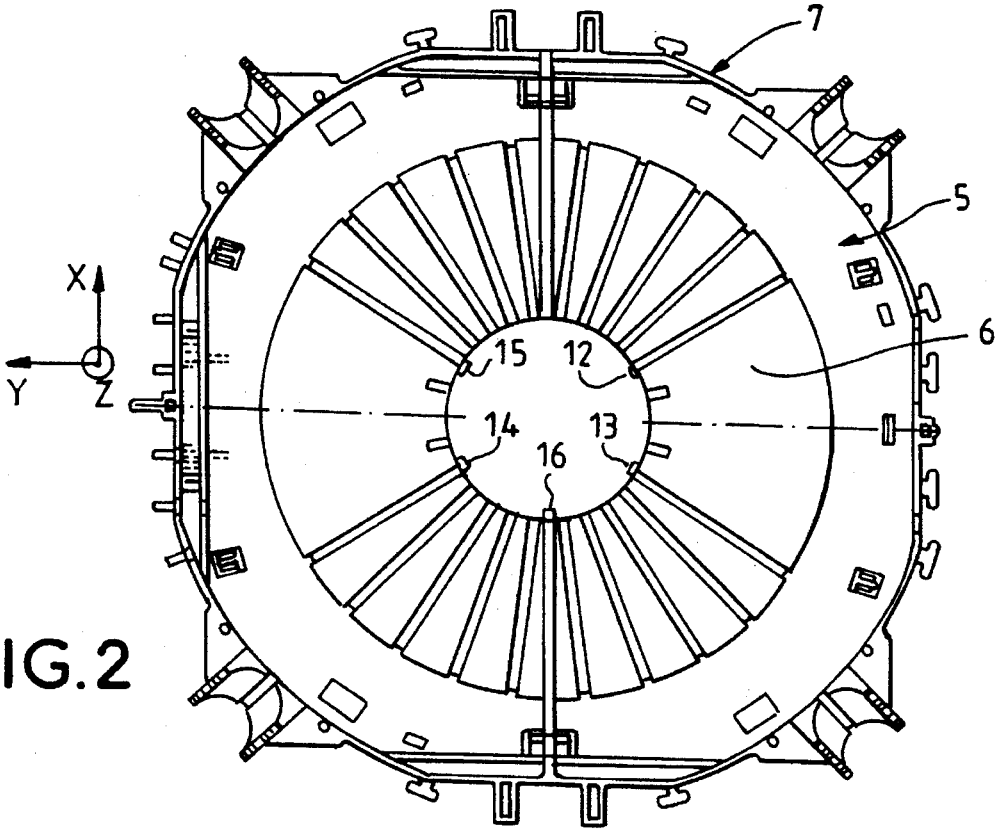
FIG. 2 illustrates a front view of the separator of FIG. 1.

Projections or studs 12, 13, 14 and 15 cooperate with holes 22, 23, 24 and 25, respectively, made in support 27 of auxiliary coils 20 and 21 of FIG. 3. A rib or tooth 16, shown in FIG. 4, projecting from wall 6 cooperates with an open slot or notch 26 made on the periphery of support 27 to establish an angular position of support 27. The anchoring arrangement is also shown in FIGS. 1 and 2. Similar symbols and numerals in FIGS. 1–4 indicate similar items or functions.

Support 27 of coils 20 and 21 is flexibly inserted into the rear part of main body 7 to surround from within the cylindrical portion of wall 6. Angular positioning is maintained by inserting tooth 16 in slot 26. Longitudinal positioning along the Z axis is obtained by s inserting studs 12 to 15 into holes 22–25, respectively, formed in support 27 of FIG. 3.

Because of its natural elasticity, support 27 tends to return to a more or less plane shape when it is not inserted within the separator. However, when support 27 is inserted within the separator, as explained before, the flexibility of support 27 causes support 27 to remain pressed against internal wall 6 of the separator.

Figure 5:
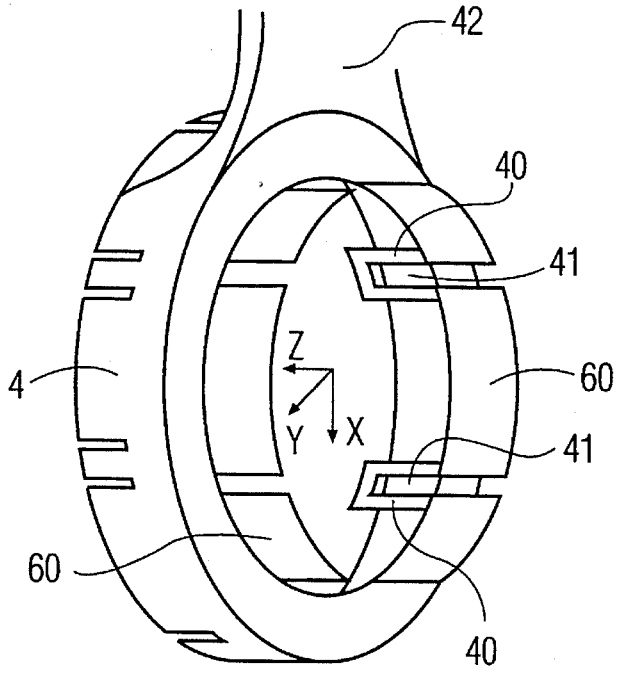
FIG. 5 is a perspective view of a retaining device of FIG. 1.

It may be desirable to retain support 27 within separator 70 so that it cannot come out of its position even when the deflection yoke is moved with respect to the CRT. The deflection yoke may be is moved when the deflection yoke is adjusted and positioned on the cathode ray tube neck. For this purpose, retaining rear part 4 of FIG. 1 is mounted on the back of body 7 of the separator. Rear part 4 is in the form of an annular cap or crown, as shown in FIG. 5. Similar symbols and numerals in FIGS. 1–5 indicate similar items or functions.

Rear part 4, embodying an inventive feature, includes, for example, four flexible pawls 40 distributed around an inner periphery of a ring and extending in a direction toward the front of the separator. Each pawl 40 has an opening 41 designed to surround the corresponding stud 12, 13, 14 or 15. Studs 12, 13, 14 and 15 project from inner wall 6 of body 7 of the separator. Pawls 40 are attached to studs 12–15 by a snapping or clipping operation so that parts 4 and 7 are fastened or latched to each other. A support 42 on which attaching devices, not shown, are located, is used for attaching a power supply connector 28 of coils 20 and 21 of FIG. 3.

Figure 6:
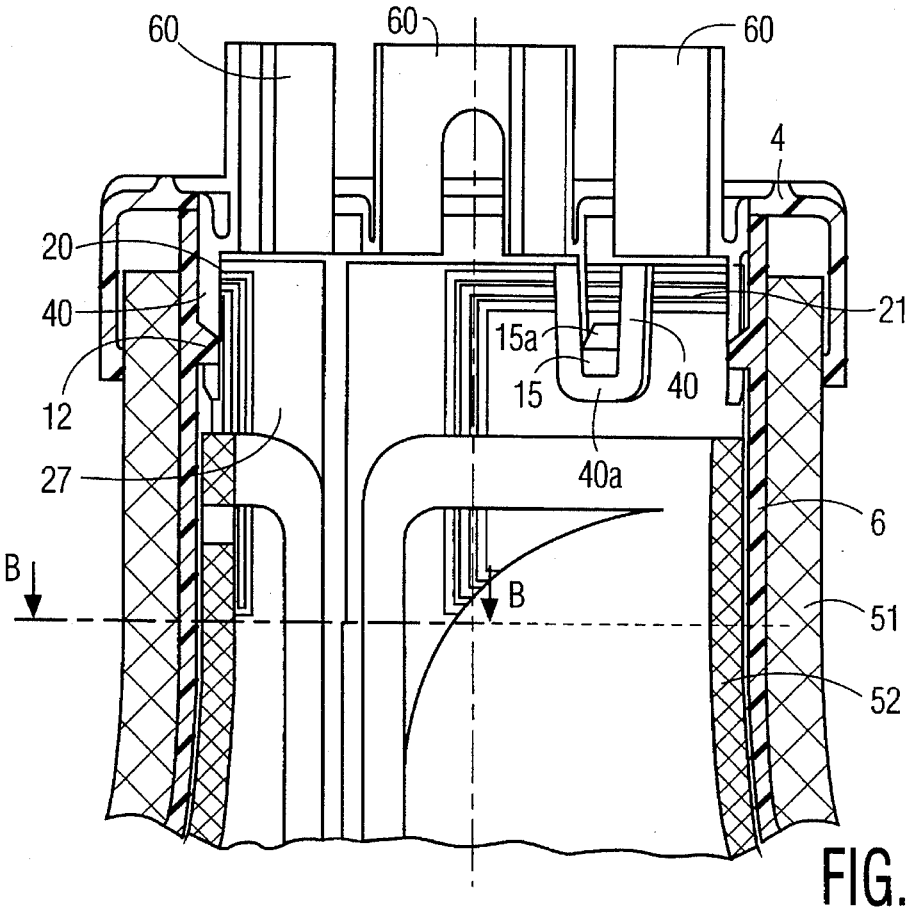
FIG. 6 is a sectional view along line A-A of FIG. 7 in a plane parallel to Z-axis at the rear of a deflection yoke utilizing the s separator of FIG. 1.
Figure 7:
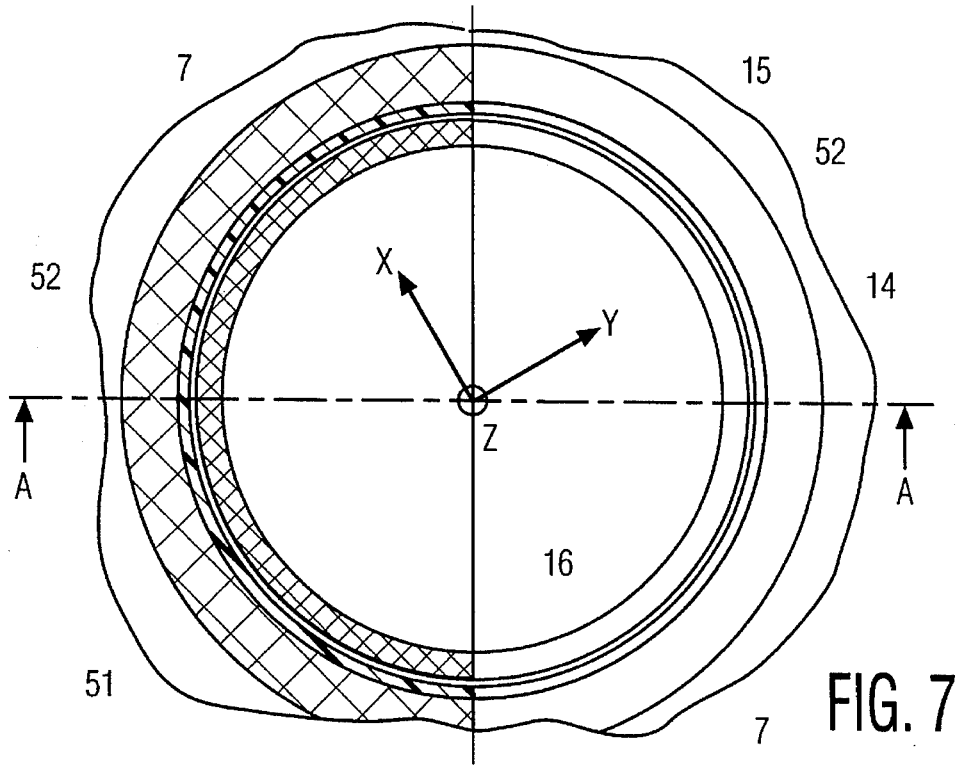
FIG. 7 is a partial sectional view along a line B-B of FIG. 6 in plane passing perpendicular to the Z-axis at the rear of the deflection yoke.

FIG. 6 shows a sectional view along a line A-A of FIG. 7 in a plane parallel to the Z-axis. FIG. 7 shows a partial sectional view along a line B-B of FIG. 6 in a plane that is perpendicular to the Z-axis at the rear part of the deflection yoke when the different parts are assembled. Similar symbols and numerals in FIGS. 1–7 indicate similar items or functions. In FIGS. 6 and 7, a rear portion of horizontal deflection coils 52 and of vertical deflection coils 51 can be seen. Pawls 40 of FIG. 6 partly overlap coils 20 and 21 and hold them in place by snapping or clipping on studs 12 to 15 that are located on inner wall 6 of body 7 of the separator. Thus, support 27 with coils 20 and 21 is disposed between pawls 40 and inner wall 6. To ensure good overall mechanical rigidity, four pawls 40 are placed symmetrically with respect to the XY and YZ planes.

Advantageously, rear part 4 is arranged in such a way that the rear part of the deflection yoke can be attached to the tube neck. Accordingly, on the periphery of rear part 4 there are flexible arcuate walls 60, extending in the opposite direction to pawls 40. As shown in FIG. 1, a clamp 3 overlaps arcuate walls 60 and attaches separator 70 on the tube neck from the rear.

What is claimed is:

1. A deflection yoke for a cathode ray tube, comprising:

a main deflection coil;

an auxiliary deflection coil mounted on a support having an opening and disposed around a neck of the tube for modifying a main deflection field of said main deflection coil;

a separator for mounting said main and auxiliary deflection coils thereon, said separator including a cylindrical part, including at least a stud that projects from a wall of said separator and said cylindrical part being provided with a positioning arrangement that cooperates with said opening for positioning said auxiliary coil against a wall of said separator.

2. A deflection yoke according to claim 1 wherein said support is made of a flexible material.

3. A deflection yoke according to claim 1 wherein said positioning arrangement comprises a plurality of studs that project from an inner wall of said separator.

4. A deflection yoke according to claim 1 wherein said opening in said support of said auxiliary coils is in a form of an open slot.

5. A deflection yoke according to claim 1 wherein said auxiliary deflection coil is at least partially covered by a retaining device.

6. A deflection yoke according to claim 5 wherein said retaining device includes a flexible pawl designed to cooperate with a stud protruding from said separator in order to latch onto said stud.

7. A deflection yoke according to claim 5 wherein said retaining device includes means for attachment to the tube neck.

8. A deflection yoke according to claim 7 wherein said attachment means is flexible.

9. A deflection yoke according to claim 1 wherein said auxiliary deflection coil comprises a beam velocity modulation coil.

10. A deflection yoke, comprising:

a yoke liner having a conical shaped body with a rear portion that is remote from a display screen when said yoke is placed on a cathode ray tube, said rear portion including a stud that protrudes from an inner wall of said rear portion;

a main deflection coil mounted on said liner; and an auxiliary coil for varying a deflection field produced by said main deflection coil, said auxiliary coil being disposed on a support member that bears against said inner wall of said rear portion, said support member including an orifice for receiving therein said stud in a manner to limit a change in position in a given direction of said support member with respect to said main deflection coil.

11. A yoke according to claim 10 wherein said support member is made of a flexible material for bending said support member around said inner wall of said rear portion such that when said yoke is placed on said cathode ray tube said support member surrounds at least a substantial portion of a neck of said cathode ray tube and is interposed between said inner wall and said neck.

12. A yoke according to claim 10 further comprising, a retaining member that is attachable to said rear portion by way of a pawl, said pawl being latched onto said stud when said retaining member is attached to said body such that said support member is interposed between said pawl and said inner wall in a manner to secure said support member to said inner wall.

13. A yoke according to claim 10 wherein said orifice in said support member is in the form of an open slot.

14. A deflection yoke, comprising:

a yoke liner having a conical shaped body with a rear portion that is remote from a display screen when said yoke is placed on a cathode ray tube, said rear portion including a stud that protrudes from an inner wall of said rear portion;

a main deflection coil mounted on said liner;

an auxiliary coil for varying a deflection field produced by said main deflection coil, said auxiliary coil being disposed on a support member that bears against said inner wall of said rear portion; and a retaining member attachable to said rear portion by way of a pawl, said pawl being latched onto said stud when said retaining member is attached to said body such that said support member is interposed between said pawl and said inner wall in a manner to secure said support member to said inner wall.

* * * * *